US005249988A

United States Patent [19]

Lu

[11] Patent Number: 5,249,988

[45] Date of Patent: Oct. 5, 1993

[54] CONNECTOR AND CONTACT THEREIN HAVING ENHANCED RETENTION AND HIGH FLEXIBILITY

[75] Inventor: Sidney Lu, Taipei, Taiwan

[73] Assignee: Foxconn International, Inc., Sunnyvale, Calif.

[21] Appl. No.: 893,385

[22] Filed: Jun. 4, 1992

[51] Int. Cl.[5] ..... H01R 13/42

[52] U.S. Cl. ..... 439/751; 439/326

[58] Field of Search ..... 439/326–328, 439/630–637, 744–747, 871, 872, 751, 873

[56] References Cited

U.S. PATENT DOCUMENTS

| | | | |
|---|---|---|---|
| 4,946,403 | 8/1990 | Billman et al. | 43/636 |
| 4,960,386 | 10/1990 | Stanevich | 439/326 |
| 5,009,611 | 4/1991 | Regnier | 439/326 |
| 5,013,264 | 5/1991 | Tondreault | 439/636 |
| 5,046,955 | 9/1991 | Olsson | 439/636 |
| 5,051,099 | 9/1991 | Pickles et al. | 439/636 |
| 5,057,032 | 10/1991 | Kaufman et al. | 439/326 |

*Primary Examiner*—David L. Pirlot

[57] ABSTRACT

An electrical connector (10) for use with a module includes an insulative elongated housing (12) and a module-receiving recess (14) which extends longitudinally within and between opposite ends (16) of the housing (12). A plurality of cavities (40) are transversely positioned along the recess (14) and open out on both sides thereof. A contact (60) is received within each cavity (40) and includes a base portion (62) in a horizontal direction. A generally S-shaped spring beams (64) extends upward from one end of the base portion (62), and a generally L-shaped spring beam (72) extends upward from the other side of the base portion (62). A retention section (76) extends upward between two spring beams (64, 72) and includes a pair of posts (78) separated along a slot (80). A notch (82) is positioned at the top of the retention section (76) in alignment with the slot (80). A rib (50) extends through the recess (14) and has a plurality of apertures (55) each in alignment with the corresponding cavity (40) to receive the retention section (76) of the contact (60). An embossment (56) is positioned within each aperture (55) to deflect the retention section (76) of the contact (60) when the connector (10) is assembled together.

14 Claims, 3 Drawing Sheets

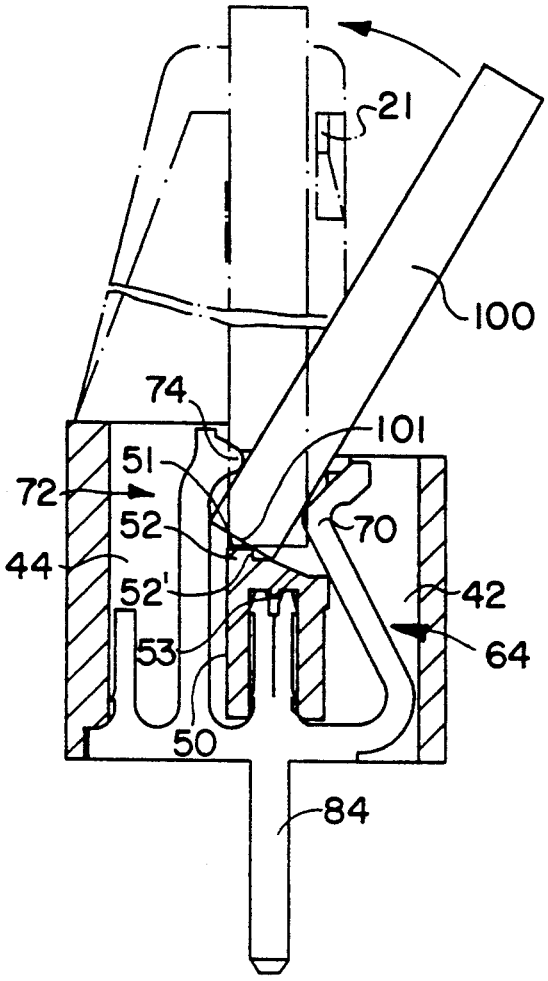
FIG. 4
FIG. 5
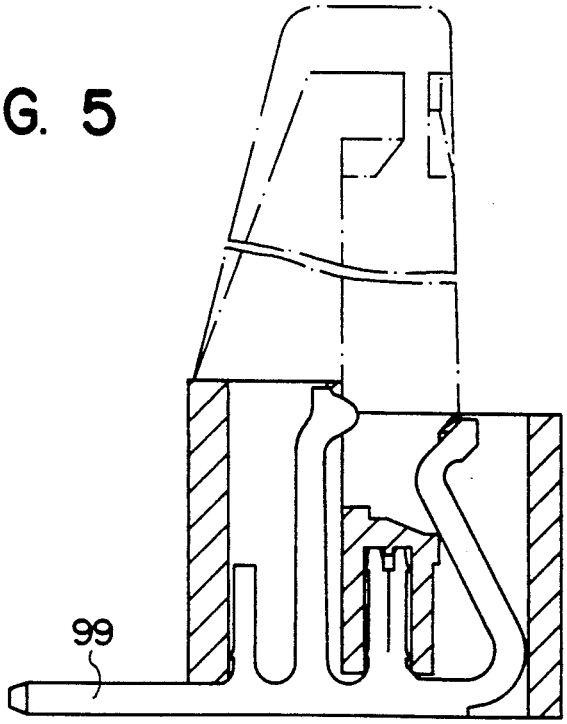

CONNECTOR AND CONTACT THEREIN HAVING ENHANCED RETENTION AND HIGH FLEXIBILITY

BACKGROUND OF THE INVENTION

1. Field of the Invention

This invention generally relates to electrical connectors and contacts for use therein and, particularly, to an improvement of retention and flexibility of the contact for the SIMM socket.

2. The Prior Art

Single in-line memory modules, i.e. "SIMM", the most popular components used in PC industry presently, represent a high density, low profile single in-line package for electronic components such as RAM integrated circuit components. For achieving high density arrangement of contacts, instead of using stamped and formed contacts, most current designs employ edge stamped contacts because the width of the former generally precludes establishing an interconnection on closer center line spacings.

Two problems follow this alternative. First, the edge stamped contact inherently has an inferior spring character to the formed contact; in other words, it is more critical to design the shape of the edge stamped contact for obtaining a sufficient retention force therebetween but still maintaining a Zero Insertion Force (ZIF) or Low Insertion Force (LIF) feature for the complementary module inserted within the socket. Moreover, the thickness of the module board received within the socket may alter in a range from 1.19 mm to 1.37 mm, so the space between two contact beams of the contact should be maintained within a proper range by which the contact can effectively engage the thinnest module board but still have a good resilience character to spring out for retractably and properly engaging the thickest module board without any permanent deformation.

The other problem is to provide the contact with a sufficient retention force within the socket without exerting a large amount of reaction or friction force during insertion of the contact into the socket.

Regarding the first issue, dissatisfaction has been found in U.S. Pat. Nos. 4,737,120 to Grabbe and 5,015,196 to Yamada which disclose each contact sandwiches an edge of a module board therein. Because they are both of the top-loading type in the housing, there is no possibility to position an engaging means on the housing in the space between two contact beams to engage the contact beam of the contact to store preloaded resilience thereof beforehand, when the module board is not inserted into the socket, for better engagement with the module board. That is, to those type contacts, the flexibility of the beams of the contact is limited and the range of accommodating variation of the module thickness is narrowed. As disclosed in U.S. Pat. Nos. 4,946,403 and 5,041,005, some attempts have been made to improve this shortcoming by using a bottom-loading contact which cooperates with engaging means of the socket to perform high deflection so as to meet the board range of variation of the module thickness.

Regarding the second issue, as disclosed in U.S. Pat. Nos. 4,713,013, 4,718,859, 4,946,403, 4,957,448, 4,960,386, 5,009,611 and 5,041,005, there are several types of retention means of the contact for securement in the socket. A general rule can be found in those designs that to obtain a stronger retention in the socket, a strong interference fit between the contact retention section and the socket is desired so that a larger force is required to insert the contact into the socket. Consequently, a expensive stronger material is preferred to form the contacts because the retention section should be stiff enough to endure the friction force exerted thereon during insertion of the contact into the socket. Also, the larger force inserting the contacts into the socket and imposed on the contacts and the socket, may damage or tilt the corresponding components .

Accordingly, this invention is directed to providing a SIMM socket having therein contacts of which, cooperating with the socket, each has a retention section which can engage the socket in an enhanced interference fit but easily pass therethrough without a larger insertion force before it reaches its final position.

Another object of the invention is to provide the contact with the retention section which is located between two beams of the contact so that a better balance for securement can be achieved when two beams engage two sides of the lower portion of the module board, respectively.

Yet, another object of the invention is to provide the contact with the retention section which is totally hidden within the socket for better securement without any external factor's effect.

Still, another object of the invention is to provide the contact with high deflection for accommodating a broad range of board thickness.

SUMMARY OF THE INVENTION

In accordance with the present invention, a socket comprises an insulative housing having a plurality of contacts within cavities in the housing. The socket employs contacts which can establish electrical connection with the pads on one or both sides of a circuit panel, such as a single in-line memory module. Each contact has a contact portion including a first beam and a second beam exposed adjacent a central recess which receives the module board therein. A hidden retention section positioned between the first beam and the second beam, has a deflectable or expansible portion with which an protrusion portion of the housing cooperates to enhance the engagement between the retention section of the contact and the housing.

The first beam has a generally S-shaped configuration and the second beam has a generally L-shaped configuration each of which abuts against at least one restraining bar of the housing to exert high deflection thereof. The housing includes a mating face which confronts the bottom edge of the module board, on which a non-flat surface is disposed for easy rotation of the module board within the slot.

BRIEF DESCRIPTION OF THE DRAWINGS

FIG. 4 is a cross-sectional view of the connector with the contact of FIG. 3 showing a module being initially and fully inserted into the housing;

FIG. 5 is a cross-sectional view of a connector showing an alternative contact positioned in the cavity in the housing in accordance with the present invention.

DESCRIPTION OF THE INVENTION

Figure 1:
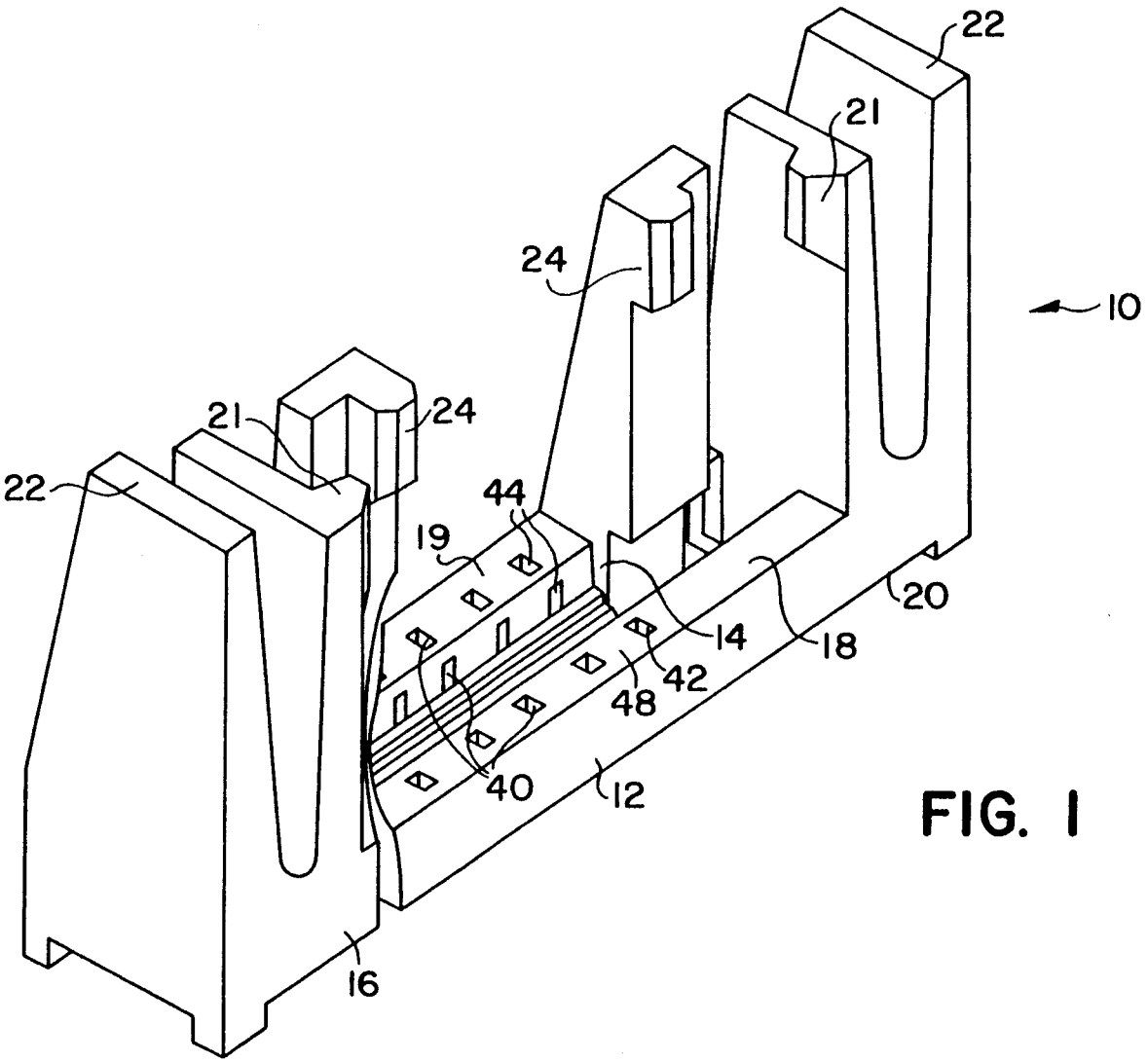
FIG. 1 is a perspective view of a SIMM connector constructed in accordance with the present invention.

With reference to FIG. 1, connector 10 of the present invention includes a housing 12 and a module-receiving recess 14 which extends longitudinally therein and between opposite ends 16 of the housing 12, and opens out on a surface 18. Also referring to FIG. 3, a plurality of contact-receiving cavities 40 are transversely provided along recess 14 and open out on both sides thereof. The cavity 40 also extends to and opens out on the surface 18 on one (front) side of the recess 14, on a surface 19 on the other (rear) side, and on a bottom surface 20 (also see FIG. 3).

Each end 16 of the housing 12 is made up of a latch 21, a stop 22 and a board positioning boss 24 (reference to U.S. Pat. No. 4,832,617 which has the same assignee as this application will provide a detailed description of such structures).

Figure 2:
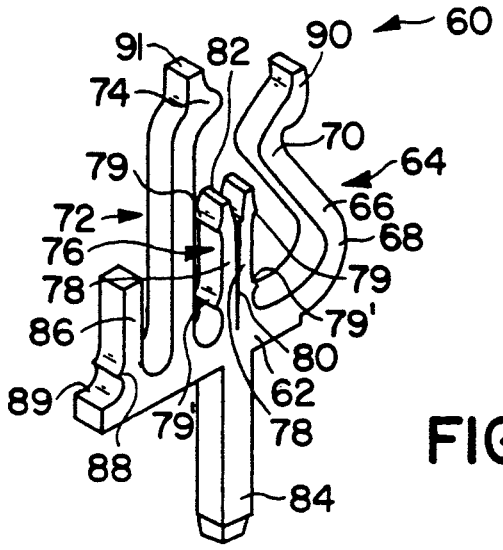
FIG. 2 is a perspective view of a contact constructed in accordance with the present invention and used in the housing.
Figure 3:
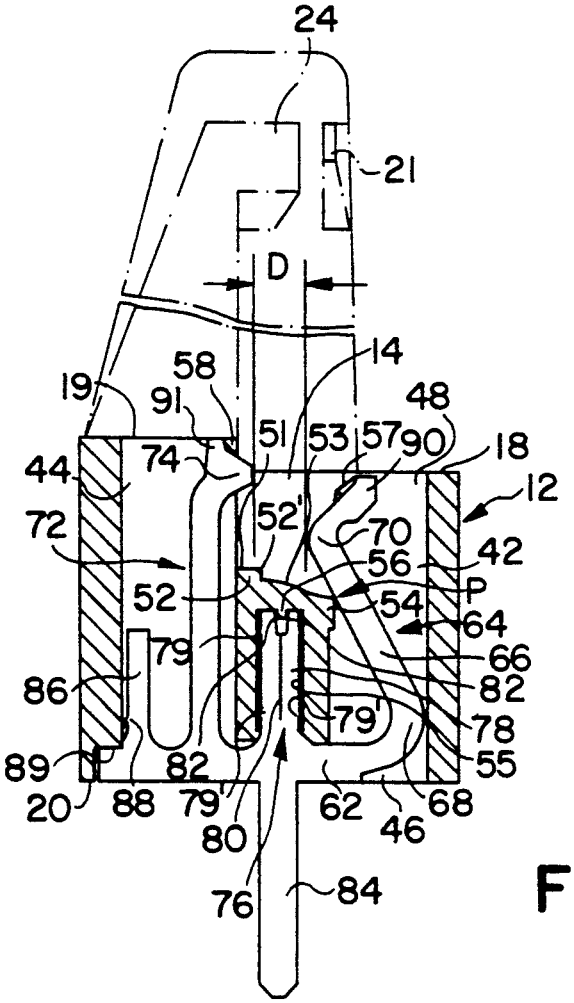
FIG. 3 is a cross-sectional view of a connector showing the contact of FIG. 2 positioned in a cavity in the housing in accordance with the present invention.

Referring to FIGS. 2 and 3, each contact 60 is positioned along the recess 40 in the housing 12. Each contact 60 edge-stamped from a metal sheet, includes a base portion 62 in a horizontal direction. A generally S-shaped spring beam, 64 extending upward from one end of the base portion 62 comprises a straight section 66 intermediate between a larger curved lower section 68 and a sharper contact upper section 70. A generally L-shaped spring beam 72 extends from the other side of the base portion 62, and carries an inward arcuate contact section 74 near the top.

From the base portion 62, a retention section 76 extends upward between two spring beams 64 and 72 until it reaches a half of the height of the L-shaped spring beam 72. The retention section 76 includes a pair of opposite posts 78 spaced apart from each other by a vertical slot 80. Each post 78 has two outward facing barbs 79 and 79' lengthwise for preventing the post 78, i.e. the contact 60 from moving backward, and a notch 82 aligned with the slot 80 is formed at the top of the retention section 76.

In this preferred embodiment, opposite to the retention section 76, a terminal portion 84 extends downward from the base portion 62 for termination at and reception within a hole in the board (not shown).

An auxiliary securing leg 86 stands upward near the other end of the base portion 62, but is lower than the retention section 76. A barb 88 projects laterally outwardly near the fixed end of the securing leg 86. A stopper 89 is positioned at the outer end of the base portion 62 beside the auxiliary securing leg 86

With reference to FIGS. 1, 2 and 3, each cavity 40 extends around and opens out on both sides of the recess 14; i.e., the cavity 40 includes a first space 42 and a second space 44 which are interconnected by a third space 46. Transverse walls 48 separate adjacent cavities 40. A longitudinally running central rib 50 defines the floor of recess 14 or a mating face 51 including an upstanding portion 52 at the rear edge, a slanted middle section 53, and a lateral protrusion 54 at the front edge. Corresponding to each cavity 40, an aperture 55 extends upwardly from the bottom surface of the rib 50 for securely receiving the retention section 76 of the corresponding contact 60. In the aperture 55 an embossment 56 is positioned on the inner surface of the rib 50 for expanding the notch 82 of the contact 60 to increase the interference fit of the contact 60 within the aperture 55.

Corresponding to each first space 42 which extends to the surface 18 and to the recess 14, a restraining bar 57 is formed at the inner upper corner to span the space 42 adjacent the surface 18 and the opening of the space 42 into the recess 14 for preventing the contact section 70 of the S-shaped beam 64 from projecting too far into the recess 14 from the space 42. Similarly, an opposite restraining bar 58 which spans the space 44 adjacent the surface 19 and the opening of the space 44 into the recess 14, is formed at another corner on the other side of the recess 14 for preventing the contact section 74 of the L-shaped beam 72 from projecting too far into the recess 14 from the space 44.

Corresponding to the restraining bar 57, the S-shaped beam 64 has an engaging section 90 extending upward at the top; similarly, corresponding to the restraining bar 58, the L-shaped beam 72 also has another engaging section 91 extending upward at the top.

As shown in FIG. 3, when assembled, the contact 60 is loaded into the corresponding cavity 40 of the housing 12 from the bottom. Initially, the S-shaped beam 64 and the L-shaped beam 72 are deflected laterally when they move along and against two sides of the rib 50 and within the spaces 42 and 44, respectively. The L-shaped beam 72 is inwardly sprung back after the contact section 74 clears the rib 50. The S-shaped beam 64 is gradually inwardly sprung back after the upper section 70 clears the rib 50. This upward movement of the contact 60 continues until the engaging section 90 of the S-shaped beam 64 engages the restraining bar 57. At the same time, the engaging section 91 of the L-shaped beam 72 abuts against the restraining bar 58. Naturally, the upper section 70 of the S-shaped beam 64 and the contact section 74 of the L-shaped beam 72 also confront the restraining bar 57 and the restraining bar 58, respectively. The engagement of the restraining bars 57, 58 provide the S-shaped beam 64 and the L-shaped beam 72 with a little pre-deflecting. In other words, the two beams 64 and 72 remain in a preloaded state with the upper section 70 of the S-shaped beam 64 and the contact section 74 of the L-shaped beam 72 extending into the module-receiving recess 14. It can be understood that the preload condition of the beam 64 or 72 allows the spring rate of the beam to be lower, thus reducing the range of normal force generated from a thin circuit module or a thick circuit module. Additionally, deflection of the two active beams 64 and 72 further reduces the effective spring rate and makes variations in module thickness less critical.

In the process of insertion of the contact 60 into the cavity 40, the notch 82 of the retention section 76 of the contact 60 confronts the embossment 56 within the aperture 55 when the contact 60 is about to be in its final fixed position. Subsequently, along the notch 82 the embossment 56 is gradually inserted into the slot 80 and forces the posts 78 to deflect outward and laterally, so that this will enhance the interference fit between the upper barb 79 and the inner surface of the rib 50 and have the post 78 sandwiched between the embossment 56 and the inner surface of the rib 50. Accordingly, the securement of the contact 60 within the cavity 40 is increased.

It should be understood that the structure and cooperation of the embossment 56 of the rib 50 and the notch 82 (or the slot 80) of retention section 76 of the contact 60 is a feature of the present invention. Through this cooperation, the contact 60 can be easily inserted into the cavity 40 by a less force because the upper barbs 79 of the posts 78 can be dimensionally designed to be only in little interference fit with the rib 50 in an initial situation before the posts 78 confront and abut against the embossment 56. It allows an easy initial insertion of the contact 60. Then, when it is about to be at the end of this insertion, the retention force can be promptly increased to a standard level by the embossment 56 strongly forcing the upper barbs 79 of the posts 78 against the inner surface of the rib 50. This two-stage orientation of the retention section 74 will smooth the insertion of the contact 60 into the cavity 40. In this embodiment of the present invention, the lower barbs 79' of the posts 78 and the barb 88 of the auxiliary securing leg 86 will join this retention near the end of the insertion of the contact 60. It will also reinforce the retention of the contact 60 in the cavity 40.

According to the present invention, the cooperation of the upper barb 79 and the opposite lower barb 79' will enhance and balance the retention of the whole contact 60. In other words, the present invention provides the contact 60 with an interference fit of a sufficient length, i.e. from the upper barb to the lower barb, and strength due to the lateral movement of the post 78 exerted by the embossment 56, but without the disadvantage of a conventional long and strong interference fit which exerts a tremendous reaction force imposed on the contact 60 to resist the insertion of the contact 60 into the cavity 40.

It is also noted that according to the FIG. 3, the portion of the base portion 62 adjacent the intersection portion of the retention section 76 and the base portion 62 abuts against the bottom of the rib 50 to stop the forward movement the contact 60 when the contact 60 is in its final position. The similar situation occurs on the stopper 89 around the intersection portion of the auxiliary securing leg 86 and the base portion 60. In this preferred embodiment as shown in FIG. 3, the tips of the posts 78 properly abut against the inner surface of the rib 50. In this condition, the retention section 76 is in good and full engagement with the aperture 55.

It is also appreciated that, similar to the top engagement section 90 in engagement with the restraining bar 57, the middle portion of the S-shaped beam 64 contacts the lateral protrusion 54 of the rib 50 at a point P, so that this engagement also provides the whole structure of the S-shaped beam 64 with being pre-deflected. Thus, the beam 64 may be made having a low spring rate resulting in little variation in normal force with changes in module thickness. Pre-flection of the beam also reduces the force needed to insert and withdraw a module. Two engagement points of the S-shaped beam, i.e. the engagement section 90 and the point P, which can largely reduce the spring rate so that contact 60 can accommodate a large range of module thickness, is also a feature of this invention.

As shown in FIG. 3, when assembled, disposed within the space 44 is the L-shaped beam 72, the contact section 74 of which projects into the recess 14 from the space 44, and disposed within the space 42 is the S-shaped section 64, the contact section 70 of which also projects into the recess from the space 42. The distance D between the apexes of two beams 64 and 72 defines minimum of the thickness of the module which is acceptable to the connector 10.

With reference to FIG. 4, when a module 100 is inserted into the recess 14 at a predetermined angle for zero insertion force (ZIF), the lower edge 101 of the module first is in compliance with the slanted middle section 53 of the rib 50 and is seated against a front corner 52' of the upstanding portion 52 of the rib 50. In this position, the module 100 slightly and even hardly contacts the L-shaped beam 72 or S-shaped beam 64 of the contact 60. Successively, the module 100 is rotated within the recess 14 through engagement between the front corner 52' and the lower edge surface 101 of the module 100. In this period, the beams 64, 72 are little cammed back (this action is not shown) into the spaces 42, 44, respectively, and the contact sections 70, 74 of the beams 64, 72 electrically engage traces (not shown) on the module 100. In this rotation period the engaging sections 90 and 91 also disengage the restraining bars 57, 58, respectively (this configuration is not shown). The point P of the S-shaped beam 64 also leaves the rib 50. These disengagements of the beams allows a larger degree of freedom of deformation for each beam to receive the module with variation. Further, as is evident, contact sections 70 and 74 slide on the traces during the insertion and thereby wipes the engaging surfaces clean. With the spring beams 64 and 72 thus resiliently deformed, the required normal force against the module traces are maintained for good electrical conductivity through the engaging surfaces.

It is contemplated that, different from the prior art, in the present invention the upstanding portion 52 incorporating the slanted middle section 53 allows the rotation of the module occurs along the narrow strip type lower edge surface 101 of the module 100. Based on this structure, because the pivotal point is positioned between two sides of the module, the rotation of the module 100 exerts a generally balanced and symmetrical force on the opposite contact sections 70 and 74. In contrast, as shown in U.S. Pat. Nos. 4,946,403 and 4,832,617, most prior art connectors each have a substantially flat mating surface within the recess and the module only can be rotated along the front lower edge line which is the only possible portion to touch the mating surface because of no slanted section thereon as disclosed in the present invention. This one side type pivot results in an unbalanced and unsymmetrical rotation which might exert an uneven force on two opposite sides of the module against the contact sections 70 and 74 and jeopardize good conductivity therethrough.

FIG. 5 shows another embodiment of the present invention, in which a terminal portion 99 laterally extends beside the auxiliary retention leg 86 in place of the vertical terminal portion 84 as disclosed in FIGS. 2–4, in compliance with surface mounting process.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. An electrical connector for use with a circuit module, comprising:

an insulative elongated housing having a module-receiving recess extending longitudinally therein;

a plurality of cavities transversely disposed along the recess; and a contact in each cavity comprising at least a contact beam for establishing electrical contact with at least one side of the circuit module; the improvement including:

at least a retention section of the contact providing an two-stage engagement with the housing said contact comprising a retention section having at least one post with at least one barb thereon, and the housing further comprising a protrusion portion thereof whereby a two-stage engagement is provided with the housing, so that a minor interference fit occurs between the retention section of the contact and the housing during a first stage insertion process for easy insertion of the contact, and an enhanced interference fit is obtained between the retention section of the contact and the housing during a second stage insertion process by means of said protrusion portion forcing said post to deflect outward and laterally against an opposite inner surface of the housing wherein the post is sandwiched between said protrusion portion and said inner surface of the housing and wherein said enhanced interference fit lasts continuously for permanently and strongly fixedly retaining the contact within the cavity.

2. The electrical connector as described in claim 1, wherein the housing comprises a longitudinal central rib having an aperture corresponding to each cavity for reception of the retention section of each contact.

3. The electrical connector as described in claim 1, wherein the contact has an auxiliary retention leg extending at an end thereof.

4. The electrical connector as described in claim 1, wherein the contact has two contact beams on two opposite sides of the retention section, and each beam protrudes into the recess for engagement with the module received therein.

5. The electrical connector as described in claim 4, wherein one of said two beams has a generally S-shaped configuration and the other has a generally L-shaped configuration.

6. The electrical connector as described in claim 4, wherein two restraining bars are positioned on two sides of the recess within each cavity for pre-deflecting two contact beams, respectively.

7. An electrical connector for use with a circuit module, comprising:

an insulative elongated housing having a module-receiving recess extending longitudinally therein;

a plurality of contacts transversely disposed along the recess for engagement with the module received therein;

a retention section of each contact for securing the contact to the housing; and a longitudinal central rib extending through the recess, said rib defining a mating surface for engagement with a lower edge of the module wherein said mating surface includes a slanted section facing forwardly in compliance with the insertion of the module at a predetermined angle, and further includes at a rear edge an upstanding portion having a front corner, which the lower edge of the module is engaged against and rotatable about, to incorporate the slanted section for easy rotation of the module within the recess.

8. An electrical connector for use with a circuit module, comprising:

an insulative elongated housing having a module-receiving recess extending longitudinally therein;

a plurality of contacts transversely disposed along the recess for engagement with the module received therein;

each contact including a base portion, two opposite spring beams and a retention section extending upward therefrom wherein the retention section is positioned between said two beams; and a longitudinal central rib extending through the recess and having a plurality of apertures each to receive the retention section of each contact therein, so that the retention section of each contact is protected and hidden by said rib from any external effects and a balanced securement of said two beams can be achieved due to said retention section therebetween.

9. The electrical connector as described in claim 8, wherein corresponding to each contact, two restraining bars predeflect said two beams, respectively.

10. The electrical connector as described in claim 9, wherein said rib comprises a lateral protrusion to predeflect one beam of the contact so that at least one beam of the contact has two-point engagement with the housing to enhance its pre-flection.

11. An edge stamped contact for use with a connector receiving a module therein, comprising:

(a) a horizontal base portion;

(b) a generally S-shaped beam directly extending upward from an end of said base portion;

(c) a generally L-shaped beam directly extending upward from another end of said base portion;

(d) an expansible retention section directly extending upward from the base portion and between said two beams; said retention section being independently spaced apart from said two beams; and (e) a terminal portion extending from the base portion.

12. The contact as described in claim 11, wherein the retention section comprises two posts separated along a slot, and a notch is positioned at the top of said retention section in alignment with said slot.

13. The contact as described in claim 12, wherein the contact further comprises an auxiliary retention leg, and the S-shaped beam comprises a straight section intermediate between a larger curved lower section and a sharper contact upper section.

14. An electrical connector having various engagements with a contact received therein for establishing electrical connection with an electrical component, comprising:

a housing having at least one cavity to receive the corresponding contact therein, said housing further comprising a longitudinal rib with at least one aperture therein, en embossment positioned within said aperture; and said contact including:

a contact portion for mating with an electrical circuit of said electrical component;

a terminal portion for terminating with another electrical component; and an expansible retention section for engagement within the aperture in the rib of the housing, said expansible retention comprising a pair of posts separated along a slot, a notch aligned therewith at the top, at least one barb positioned on each post so that in assembling, an easy insertion of the contact into the cavity is obtained in a first stage due to a small initial lateral dimension of the retention section, and an enhanced interference fit occurs between the retention section and the housing in a second stage due to deflection of the retention section resulting from the embossment gradually inserted into the slot and forcing the corresponding posts to deflect outward and laterally thus increasing the lateral dimension of the retention section whereby the enhanced interference fit lasts continuously for permanently and strongly fixedly retaining the contact within the cavity.

* * * * *